US012195159B2

(12) United States Patent
Pajank et al.

(10) Patent No.: US 12,195,159 B2
(45) Date of Patent: Jan. 14, 2025

(54) WING RIG AND KITE

(71) Applicant: Boards & More GmbH, Molln (AT)

(72) Inventors: Max Pajank, Molln (AT); Antonio Destino, Molln (AT); Till Eberle, Molln (AT)

(73) Assignee: Boards & More GmbH, Molln (AT)

( * ) Notice: Subject to any disclaimer, the term of this patent is extended or adjusted under 35 U.S.C. 154(b) by 0 days.

(21) Appl. No.: 18/286,814

(22) PCT Filed: Apr. 12, 2022

(86) PCT No.: PCT/EP2022/059705
§ 371 (c)(1),
(2) Date: Oct. 13, 2023

(87) PCT Pub. No.: WO2022/218959
PCT Pub. Date: Oct. 20, 2022

(65) Prior Publication Data

US 2024/0190547 A1 Jun. 13, 2024

(30) Foreign Application Priority Data

Apr. 15, 2021 (DE) ..... 102021109487.9
May 11, 2021 (DE) ..... 102021112344.5
(Continued)

(51) Int. Cl.
*B63H 8/12* (2020.01)
*B63H 8/14* (2020.01)
*B63H 8/16* (2020.01)

(52) U.S. Cl.
CPC ..... *B63H 8/12* (2020.02); *B63H 8/14* (2020.02); *B63H 8/16* (2020.02)

(58) Field of Classification Search
CPC ..... B63H 8/12; B63H 8/14; B63H 8/16
See application file for complete search history.

(56) References Cited

U.S. PATENT DOCUMENTS 4,563,969 A * 1/1986 Le Bail ..... B63H 8/10 114/102.16
4,927,100 A 5/1990 Provenzo, Jr. et al.
(Continued)

FOREIGN PATENT DOCUMENTS

DE 19908223 A1 8/2000
DE 202004005792 U1 6/2004
(Continued)

OTHER PUBLICATIONS

"Freewing Air V2", Dec. 2, 2021, taken from archive.org, https://freewing.star-board.com/freewing-air/ (Year: 2021).*
(Continued)

*Primary Examiner* — Brian M O'Hara
(74) *Attorney, Agent, or Firm* — Mindful IP PLLC; Michael J. McCandlish

(57) ABSTRACT

A hand-held wing rig includes an inflatable front tube forming a leading edge and a rigid or inflatable center strut which together span a canopy. A radially projecting spoiler profile is formed approximately in the lower region of the leading edge. In use, the spoiler profile is tangentially flowed against, facing a user. Further disclosed is a kite including a spoiler profile formed approximately in the lower region of the leading edge, which is tangentially flowed against.

16 Claims, 6 Drawing Sheets

(30) Foreign Application Priority Data

| | | |
|---|---|---|
| Jun. 24, 2021 | (DE) | 102021116387.0 |
| Jul. 2, 2021 | (DE) | 202021103570.6 |
| Sep. 30, 2021 | (DE) | 102021125438.8 |
| Sep. 30, 2021 | (DE) | 202021105301.1 |

(56) References Cited

U.S. PATENT DOCUMENTS

| | | | | |
|---|---|---|---|---|
| 5,448,961 | A | 9/1995 | Ansteensen | |
| 5,826,530 | A * | 10/1998 | Tuurna | B62B 15/002 114/102.11 |
| 10,336,412 | B2 * | 7/2019 | Morris | B63H 8/16 |
| 2022/0371710 | A1 * | 11/2022 | Winner | B63H 8/10 |

FOREIGN PATENT DOCUMENTS

| | | | |
|---|---|---|---|
| DE | 102004042669 | A1 | 8/2005 |
| DE | 102004051708 | A1 | 4/2006 |
| DE | 202005018317 | U1 | 4/2006 |
| DE | 102005002941 | A1 | 7/2006 |
| DE | 102020122143 | A1 | 5/2021 |
| DE | 102020122145 | A1 | 5/2021 |
| DE | 102021106993 | A1 | 2/2022 |
| WO | 9505973 | A1 | 3/1995 |
| WO | 2017059275 | A1 | 4/2017 |
| WO | 2020152198 | A1 | 7/2020 |

OTHER PUBLICATIONS

Drift Surf Wing; URL: https://switchkites.com/products/drift-surf-wing, archiviert in https://archive.org/ am Apr. 13, 2021 [abgerufen am Mar. 9, 2023].

Freewing Air, URL:https://freewing.star-board.com/de/freewing-air/, archiviert in http://archive.org/am Jun. 17, 2020 [abgerufen am 09.03.20223].

Grenzschichtablösung. In: Wikipedia, Die freie Enzyklopädie. Bearbeitungsstand: Feb. 14, 2021, 19:04.

Profil (Strömungslehre) In: Wikipedia, Die freie Enzyklopädie. Bearbeitungsstand: Nov. 16, 2020, 11:15.

Schlichting, H. et al. Aerodynamik des Flugzeuges: Grundlagen aus der Strömungsmechanik, Aerodynamik des Tragflügels (Teil I), 1959, S. 241-242.

German search report issued Mar. 10, 2023 in correlated German Application No. 10 2021 125 438.8.

* cited by examiner

WING RIG AND KITE

CROSS-REFERENCE TO RELATED APPLICATIONS

This application is a US National Phase of International Patent Application Number PCT/EP2022/059705, filed Apr. 12, 2022, claiming priority to German Patent Applications DE 10 2021 109 487.9 filed Apr. 15, 2021, DE 10 2021 112 344.5 filed May 11, 2021, DE 10 2021 116 387.0 filed Jun. 24, 2021, DE 20 2021 103 570.6 filed Jul. 2, 2021, DE 10 2021 125 438.8 filed Sep. 30, 2021, and DE 20 2021 105 301.1 filed Sep. 30, 2021, the contents of each of which are incorporated by reference in their entireties into the subject matter of the present application.

TECHNICAL FIELD

A first partial idea of the disclosure relates to a (hand-held) wing rig for wind-powered sports, for example foil surfing, according to the generic concept of an independent claim.

BACKGROUND

A wing rig, also called a "foil wing" or "wing foil", is a type of wing similar to a kite with a front tube, forming a leading edge, and a central center strut, which is preferably inflatable.

U.S. Pat. No. 4,563,969 shows a rigid wing rig in which the leading edge and a boom are formed by a complex tubular structure spanning a canopy. The leading edge is curved in an arc as seen in a plan view. The boom is supported by a plurality of struts on the leading edge. These struts are designed in such a way that they give the leading edge a concave structure in a front view, i.e., viewed in the inflow direction of the wing rig, in which the tips of the wing rig are flared upwards from a central apex of the leading edge.

One disadvantage of this solution is that due to the complex structure of the boom and the leading edge, the total weight of the wing rig is very high, so that use in water sports is only possible with appropriate buoyancy bodies. Another disadvantage is that the assembly and disassembly of the wing rig takes a long time due to the complex tube structure. The hard tube structure of the leading edge and boom also brings a significant risk of injury to the user in the event of a skidding fall, and the aerodynamics of this rig are also not optimal due to the complex structure.

A similar rigid wing rig is shown in WO 95/05973 A1. Also in this solution, the leading edge and the boom are formed by a complex tubular structure. The structure shows the same disadvantages as the wing rig according to U.S. Pat. No. 4,563,969 discussed above.

In document U.S. Pat. No. 5,448,961 a flat wing rig with a closed frame structure is described—such a solution is also not usable for water sports due to the high weight, time-consuming assembly/disassembly and the risk of injury.

Accordingly, the solutions mentioned at the beginning, in which the wing rig is designed with an inflatable center strut on which holding loops are provided for holding, have become established. These concepts are characterized by low weight and comparatively high buoyancy, but do not meet higher aerodynamic requirements.

As explained, these wing rigs are usually guided by hand, whereby the setting of the wing rig in relation to the wind must always be changed depending on the wind strength and the wind direction as well as the planned maneuver. Depending on the angle of attack to the water surface and with reference to the vertical axis of the user, the grip position, in particular of the rear, trailing edge-side hand, can change. However, the holding loops usually provided make it difficult to change the holding position in this way.

In WO 2020/152198 A1, which also goes back to the applicant, an improved wing rig is described in which a rigid boom is used instead of or in addition to an inflatable center strut, which makes handling much easier because this boom can be gripped according to the surfer's preference and the surfer does not have to orient himself to the holding loops which are usually provided.

The applicant has also filed several subsequent patent applications which further develop the wing rigs of this type with regard to aerodynamics and manageability. For example, DE 10 2020 122 143 describes a wing rig with a stiffened leading edge. DE 10 2020 122 145 discloses a wing rig in which handle recesses are formed on the inflatable center strut, which are overstretched by handles. Replaceable handles are described in DE 10 2020 121 553.

All of these latter solutions have been very successfully introduced to the market and have successfully evolved the original concept.

Nevertheless, there is a desire to further improve the performance of such wing rigs. Accordingly, the disclosure is based on the task of developing a wing rig with improved propulsion or flight characteristics.

SUMMARY

This task is solved by a wing rig with the features of an independent claim.

Advantageous further examples of the first partial idea of the disclosure are the subject of the dependent claims and are explained below.

The hand-held wing rig according to the disclosure has an inflatable front tube forming a leading edge and a rigid or inflatable center strut, with at least one handle optionally arranged on the latter. In principle, mixed forms of at least one handle/boom and an inflatable center strut can also be realized. The center strut and the front tube together span a canopy. According to the disclosure, a radially projecting profile lip, hereinafter referred to as a spoiler profile, is formed in the region of the leading edge and extends along a partial region of the leading edge/front tube approximately transversely to the center strut. This is preferably designed in such a way that flow separation occurs in the area provided with the spoiler profile. Thus, the spoiler profile acts in a similar way to a spoiler.

Surprisingly, it was found that this spoiler profile, which is located in the inflow/outflow area of the wing rig, significantly improves the performance of the wing rig compared to conventional solutions. For example, the spoiler profile according to the disclosure significantly simplified the handling of the wing rig during a turn, since the uplift of the wing rig is greater than with conventional solutions, thus, simplifying the handle change during the turn. The rolling of the wing rig during a turn is also simplified by the improved aerodynamics according to the disclosure. At the same time, however, the roll or pitch stability of the wing rig during cruise/flight could also be improved, the latter even being brought from negative to positive (unstable to stable) compared to conventional solutions. Another advantage is that the wing rig can be held very stably on a leash or on a handle, for example, when riding down a wave. In addition, the driving speed could be increased significantly compared to a conventional wing rig.

In summary, it was surprisingly shown that the spoiler profile formed along the longitudinal extension of the front tube significantly improves the performance of the wing rig compared to conventional solutions.

It is particularly preferred if the spoiler profile is formed on the underside, i.e., the side facing the user/surfer of the leading edge or wing rig or front tube, which in use is preferably flowed against approximately tangentially (underside).

The spoiler profile is located in the apex area of the leading edge of the wing rig, i.e., in the area that is flowed against approximately tangentially during use.

In a preferred solution, the spoiler profile roughly follows the contour of the leading edge of the wing rig in its longitudinal direction, at least section-wise. The spoiler profile can be continuous or interrupted in certain areas.

According to a further development of the disclosure, the aerodynamics is further improved if the spoiler profile has a height of less than 15 mm, preferably less than 10 mm, with respect to an outer skin of the front tube. That is, the protrusion of the spoiler profile over this outer skin is relatively small. Preferably, however, the spoiler profile has a height of more than 5 mm.

In an example, it is envisaged that the spoiler profile is also selected as a function of the material of the outer skin. For example, in the case of a textile material, in particular woven material, such as Dacron®, the height of the spoiler lip can be greater than or equal to 5 mm, preferably greater than or equal to 6 mm. When using foil-like material/foil material or laminate/material manufactured in the manner of a laminate for the outer skin, the height is preferably somewhat greater than in the case of woven materials and can then be approximately in the range of ≥7 mm, preferably ≥8 mm.

It is particularly preferred if the spoiler profile is formed by a seam which can be covered by an outer skin or reinforcement. This seam can then also form the closing seam of the outer skin. In the case of a hybrid material in which the base material (textile/laminate/film) of the front tube consists, for example, of a laminate/foil material designed with textile (Dacron®) reinforcements in the seaming area, the height of the spoiler profile preferably corresponds at least to the height of the base material in the seaming area and is preferably correspondingly increased in the reinforced areas.

Usually, the canopy and also the front tube of the wing rig are composed of several panels. Accordingly, the seam forming the spoiler profile can be somewhat higher in the area of the panel segment transitions, which are also joined together again by seams, than in the adjacent areas. For example, the seam, and thus, the spoiler profile can essentially have a height of about 5 mm (or 6 mm) and then be designed somewhat higher in the area of the segment transitions between the panels, for example with a height of 5.5 mm (6.5 mm). When using foils/laminates (Aluula®), the seam height is preferably somewhat higher, as explained, so that it is predominantly 7 mm, for example, and a spoiler profile height of 7.5 mm then arises in the segment transition due to the material doubling.

Accordingly, the spoiler profile can be designed, for example, as a seam, optionally with a material doubling, cover or the like. Alternatively, a spoiler profile body is attached to the front tube of the wing rig. This can be, for example, a plastic/channel profile suitably connected to the outer skin of the front tube or formed integrally therewith. This spoiler profile can be fixed in position, for example, by gluing and/or sewing.

In an example, the spoiler profile is formed by a profile body covered by a cover. This cover improves aerodynamics and also provides improved positional fixation.

In an example, the spoiler profile extends in the region of the front tube that lies between the tips of the wing rig.

In principle, the spoiler profile can be designed to cause a stall or a flow reversal (laminar/turbulent) at the underside of the wing rig.

It is particularly preferred if the spoiler profile is not rounded, but forms a stalling edge.

In one example of the disclosure, the spoiler profile is provided with an adhesive layer for subsequent attachment to a conventional wing rig. Accordingly, the spoiler profile may then be formed with a widened base.

Furthermore, it is expedient if several spoiler profile sections are arranged at a distance from one another and/or are designed with different heights.

The applicant reserves the right to direct a separate independent patent claim to this spoiler profile.

Furthermore, a second sub-idea of the disclosure relates to a kite for wind-powered sports, for example kite surfing, according to the generic concept of an independent claim.

Conventional kites used for kite surfing or land kiting are either designed as tube kites or as mats with chambers that can be filled by the inflow. The great advantage of tube kites for kitesurfing is that they float in the event of a crash and can therefore be relaunched without major problems.

Tubekites usually have a support structure with an inflatable front tube and inflatable struts arranged transversely thereto, which together span a canopy. Such a tubekite is marketed, for example, by the applicant under the trademark Rebel®. Different versions of this concept are described in DE 20 2004 005 792 U1 or DE 10 2004 042 669 A1.

Kites with high demands on maintaining the predetermined aerodynamically optimized profile during different maneuvers, such as high-performance Rebel® or Vegas® type kites, usually use multiple struts to stabilize the inflow profile. Lighter kites typically use fewer struts, wherein, for example, a single center strut may be sufficient. There are also solutions on the market without struts.

Despite the successful introduction of such concepts on the kite market, there is still a desire to further improve the performance of such kites. Accordingly, in this context, the disclosure is based on the task of developing a kite with improved flight characteristics.

This task is solved by a kite with the features of an independent claim.

Advantageous further developments of the second partial idea of the disclosure are subject of the dependent claims and are explained below. These further developments follow from those of the first partial idea, but for the sake of completeness are also explained again in detail below with reference to the second partial idea.

The kite according to the disclosure has an inflatable front tube forming a leading edge and preferably at least one inflatable strut. The strut(s) and the front tube together span a canopy. According to the disclosure, a radially projecting profile lip, hereinafter referred to as a spoiler profile, is formed in the region of the leading edge and extends along a partial region of the leading edge/front tube approximately transversely to the center strut. This is preferably shaped in such a way that flow separation occurs in the area provided with the spoiler profile. Thus, the spoiler profile acts in a similar way to a spoiler.

It was also shown in a surprising way with regard to the kite that this spoiler profile, which is located in the inflow/outflow area of the kite, significantly improves the performance of the kite compared to conventional solutions. Thus, the handling of the kite during maneuvers could be significantly improved with the spoiler profile according to the disclosure, since the uplift and the flight stability are higher than with conventional solutions.

Thus, it is surprisingly shown that the spoiler profile formed along the longitudinal extension of the front tube significantly improves the performance of the kite compared to conventional solutions.

It is particularly preferred if the spoiler profile is formed on the underside, i.e., the side of the leading edge (/ front tube) of the kite facing the user/surfer,), which in use is preferably flowed against approximately tangentially (underside).

The spoiler profile is preferably located in the apex area of the leading edge of the kite, i.e., in the area which is flowed against approximately tangentially during use.

In a preferred solution, the spoiler profile roughly follows the contour of the leading edge of the kite in its longitudinal direction, at least section-wise. The spoiler profile can be continuous or interrupted in certain areas.

According to a further development of the disclosure, the aerodynamics is further improved if the spoiler profile of the kite is designed with a height of less than 15 mm, preferably less than 10 mm, with respect to an outer skin of the front tube. That is, the protrusion of the spoiler profile above this outer skin is relatively small. Further preferably, the spoiler profile of the kite has a height of more than 3 mm.

In one example, it is envisaged that the spoiler profile is also selected as a function of the material of the outer skin. For example, in the case of a textile material, in particular woven material, such as Dacron®, the height of the spoiler lip can be greater than or equal to 3 mm, preferably greater than or equal to 5 mm. When using foil-like material/foil material or laminate/material manufactured in the manner of a laminate for the outer skin, the height is preferably somewhat greater than in the case of woven materials and can then be approximately in the range of ≥5 mm, preferably ≥6 mm, further preferably ≥7 mm.

It is particularly preferred if the spoiler profile is formed by a seam which can be covered by an outer skin. This seam can then also form the closing seam of an outer skin of the front tube.

In the case of a hybrid material in which the base material of the front tube consists, for example, of a laminate/foil material designed with textile (Dacron®) reinforcements in the seaming area, the height of the spoiler profile preferably corresponds at least to the height of the base material (textile/laminate/film) in the seaming area and is further preferably correspondingly increased in the reinforced areas.

Usually, the canopy and also the front tube are composed of several panels. Accordingly, the seam forming the spoiler profile can be somewhat higher in the area of the panel segment transitions, which are also joined together again by seams, than in the adjacent areas. For example, the seam, and thus, the spoiler profile can essentially have a height of about 3 mm (or 5 mm) and then be designed somewhat higher in the area of the segment transitions between the panels, for example with a height of 3.5 mm (5.5 mm). When using foils/laminates (Aluula®), the seam height is preferably somewhat higher, as explained, so that it is predominantly 5 mm, for example, and a spoiler profile height of 5.5 mm then arises in the segment transition due to the material doubling.

Accordingly, the spoiler profile can again be designed, for example, as a seam, optionally with a material doubling, cover or the like. Alternatively, a spoiler profile body is attached to the front tube. This can be, for example, a plastic/channel profile suitably connected to the outer skin of the front tube or formed integrally therewith. This spoiler profile can be fixed in position, for example, by bonding and/or sewing.

In an example, the spoiler profile is again formed by a profile body covered by a cover. This cover improves aerodynamics and also provides improved positional fixation.

In an example, the spoiler profile extends in the region of the front tube that lies between the tips of the kite.

In principle, the spoiler profile can be designed to cause a stall or a flow reversal (laminar/turbulent) at the bottom of the kite.

It is therefore again particularly preferred if the spoiler profile is not rounded but forms a stalling edge.

In an example, the spoiler profile is provided with an adhesive layer for subsequent attachment to a conventional kite. Accordingly, the spoiler profile may then be formed with a widened base.

Furthermore, it is expedient if several spoiler profile sections are arranged at a distance from each other and/or are designed with different heights (h).

BRIEF DESCRIPTION OF THE DRAWINGS

Advantageous further examples of the disclosure are explained in more detail below with reference to schematic drawings. Those show.

DESCRIPTION

Figure 1:
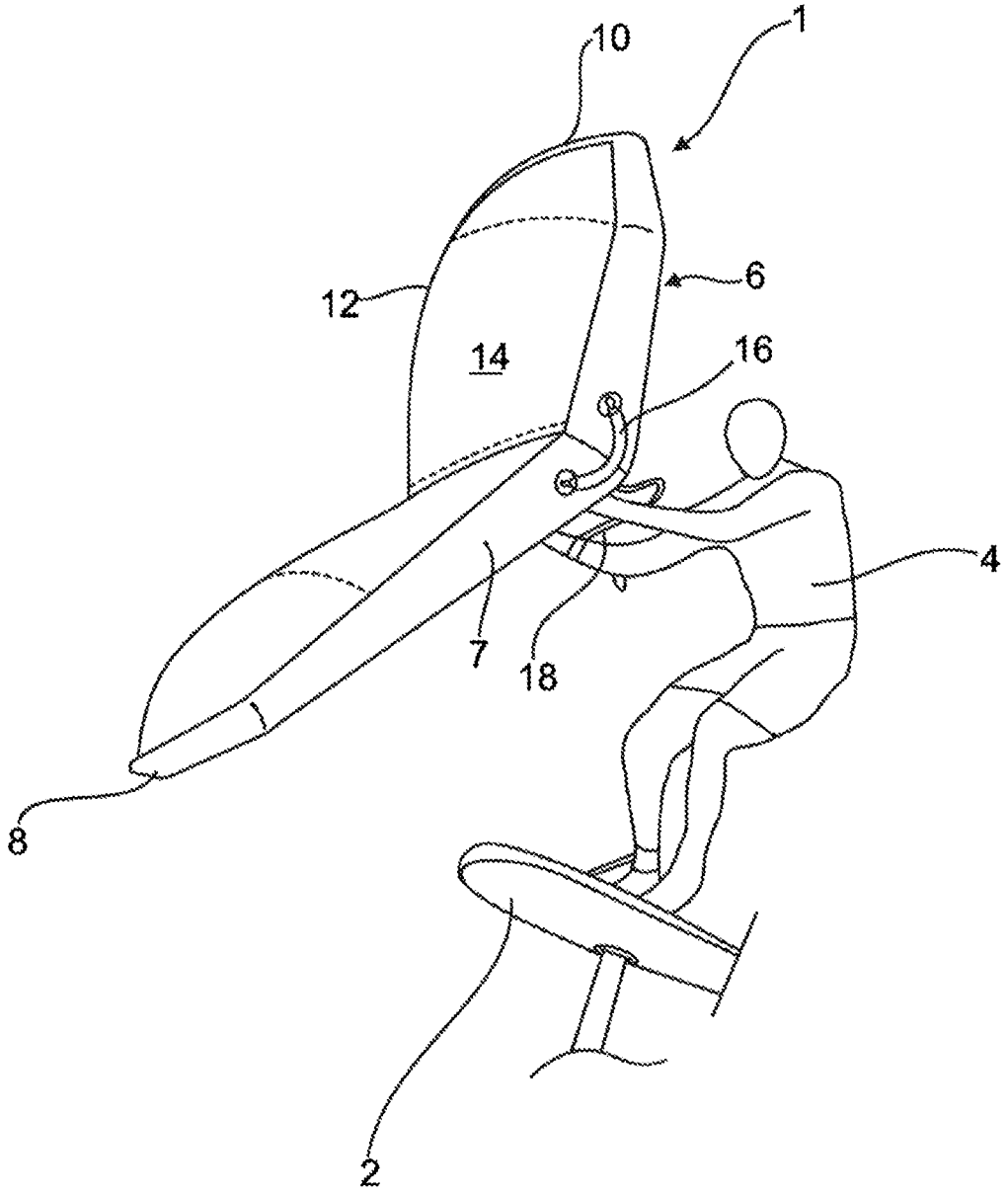
FIG. 1 shows the principle of a wing rig used to propel a foil board.

FIG. 1 shows the use of a wing rig 1 (also called "wing", "foil wing" or "wing foil") according to the disclosure to propel a foil board 2. A surfer 4 usually holds the wing rig 1 with his hands and adjusts it with respect to the wind depending on the desired direction of travel (upwind, half-wind, downwind) or the uplift to be set, for example when jumping or adjusting the ride height.

The wing rig 1 has an inflatable front tube 6 with an upstream leading edge 7, which in plan view (from above in FIGS. 1 and 2) is approximately arc-shaped, preferably approximately delta-, C- or U-shaped, and extends with its tips 8, 10 up to a trailing edge 12 of a canopy 14 of the wing rig 1. As explained in the following, this canopy 14 is spanned on the one hand by the front tube 6 and on the other hand by a boom/center strut 20 (see FIG. 2), which will be explained in more detail in the following. The surfer 4 thereby holds the wing rig 1 mainly at the boom/center strut 20, which cantilevers downwards (view according to FIG. 1). The front tube 6 is preferably set in an approximately V- or U-shape both in the top view and in a front view—seen in the direction of inflow—with the V/U widening upwards, i.e., away from the surfer 4, in the front view. As can be seen in FIG. 1, the trailing edge 12, and thus, the entire canopy surface is also V- (or U-) shaped in the front view.

The reference sign 16 is exemplarily used to indicate a handle which is arranged centrally in the area of the front tube 6. This handle 16 is gripped, for example, when the wing rig 1 is held downwind while sailing on a wave without propulsion. This handle 16 is also used when handling the wing rig 1 on land or when launching or terminating a trip (water landing). As explained below, other handles may be positioned on the wing rig 1.

In the illustration according to FIG. 1, a safety leash 18 is still shown, which is attached to the wrist of the surfer 4, for example, and whose other end section engages the front tube 6.

Figure 2:
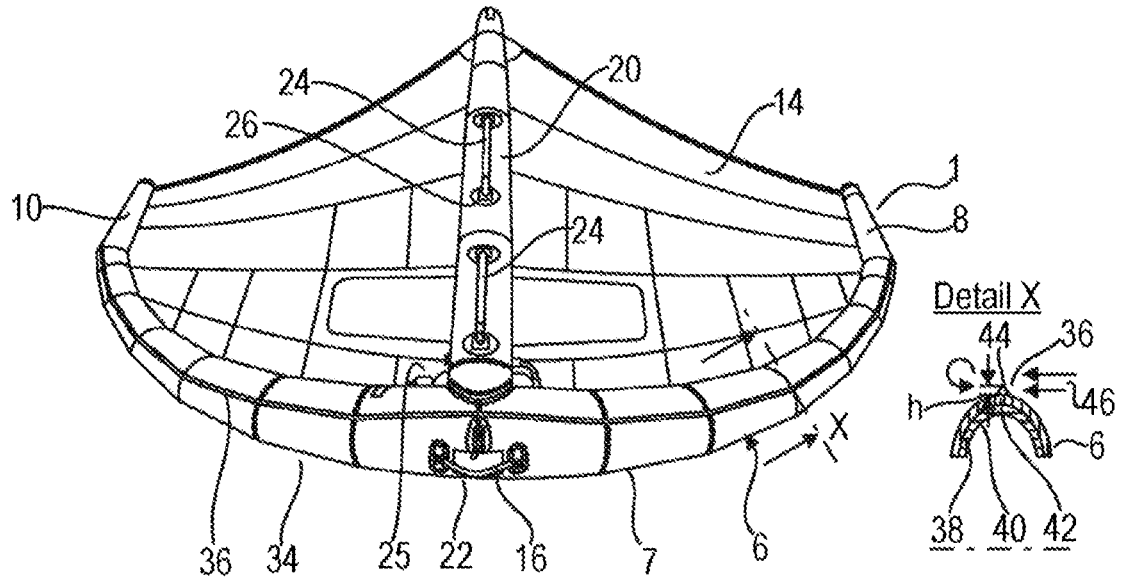
FIG. 2 a partial bottom view of a wing rig according to an example.

FIG. 2 shows a bottom view of the wing rig 1, in which a center strut 20 is visible, which is connected to the front tube 6 in the area of an apex 22 of the latter. In this example, the center strut 20 is designed to be inflatable, with inflation taking place via a one-pump system 25, via which the front tube 6 is also inflated. Removable handles 24 are attached to the center strut 20, the basic structure of which is described in the DE 10 2020 121 553 mentioned at the beginning. These handles 24 are made of a dimensionally stable material, for example fiber-reinforced plastic, and are detachably screwed to the center strut 20 via adapters 26. In the exemplary example shown, two handles 24 are provided. Of course, further handles can be arranged. In principle, it is also possible to attach a larger handle which, in the manner of a continuous boom, covers the area which is overstretched by the handles 24.

As explained at the beginning, a further handle 16 is attached in the area of the apex 22, whereby this is made of a flexible material and is attached to the front tube 6. Of course, a replaceable handle 24 can also be arranged in this area.

In the view shown in FIG. 2, the front tube 6 curves in an approximately U- or C-shape towards two tips 8, 10, which in the wing rig 1 shown are not curved, or are much less curved than the curved front tube section 34 running towards the apex 22. Of course, the wing rig 1 can also be designed with a different front tube geometry.

According to the disclosure, a spoiler profile 36—also known as a bead or boundary layer trip strip (BLTS)—is arranged on the front tube section 34 in the region in which the front tube 6 bulges out most with respect to the canopy 14, i.e., in FIG. 2 in the region of the front tube 6 facing the viewer, and in the representation according to FIG. 2 projects towards the viewer beyond the outer skin 38 of the front tube 6. In the example shown, the spoiler profile 36 is designed as a plastic profile which is suitably connected to the front tube 6, in particular to the outer skin 38 of the front tube 6. This connection can be made, for example, by bonding, sewing or by suitable design of the front tube 6. The spoiler profile 36 may be continuous or formed from spoiler profile sections spaced apart from one another.

In principle, the spoiler profile 36 can also be designed with different heights to optimize the stall.

In the example shown, this spoiler profile 36 extends from the apex 22 to the tips 8, 10, as mentioned above. No spoiler profile 36 is provided in this region, since these tips 8, 10 are arranged more or less in the direction of flow.

Section X-X of FIG. 2 schematically shows the cross-section of the spoiler profile 36. The outer skin 38 of the front tube 6 can be seen, which preferably surrounds a bladder 40 in a generally known manner. In the case of a gas-tight design of the outer skin 38, the bladder 40 can also be skipped. The cross-sectional profile of the front tube 6 is approximately circular or oval. In the area away from the canopy 14, the spoiler profile 36 is attached. In the example shown, this is formed as a plastic profile body with a comparatively wide base 42 along which the spoiler profile 36 is connected to the outer skin 38. As explained, this connection can be made by gluing, sewing or the like.

The spoiler profile 36 tapers from the base 42 to a stalling edge 44/stream, stalling edge, which, in the example shown, is of relatively sharp-edged design, so that when the wing rig 1 is in use, the incident flow marked with the reference sign 46, which runs approximately tangentially to this region of the leading edge 7, breaks off and/or changes from a largely laminar flow to a turbulent region and/or the flow separates downstream of the spoiler profile 36. Surprisingly, it was found that this change in the flow in the area of the underside of the leading edge 7 significantly improves the aerodynamics of the wing rig 1 compared to conventional solutions, so that on the one hand higher cruising speeds can be achieved and on the other hand the "flight stability" is significantly improved during maneuvers in which the wing rig 1 is only held or pivoted at the leash 17 or the handle 16, so that these maneuvers are easier to perform.

In the example shown, the height h of the spoiler profile 36 is preferably higher than 5 mm for an outer skin 38 made of Dacron®. In principle, other dimensions can also be used. In the illustrated exemplary example, the stalling edge 44 is formed with a relatively sharp edge. In principle, this can also be somewhat rounded. The profile of the spoiler profile 36 is also by no means limited to the shape shown, but the profiling can also be carried out in other ways to achieve the desired effect (for example, stall, separation or reversal laminar/turbulent flow).

Figure 3:
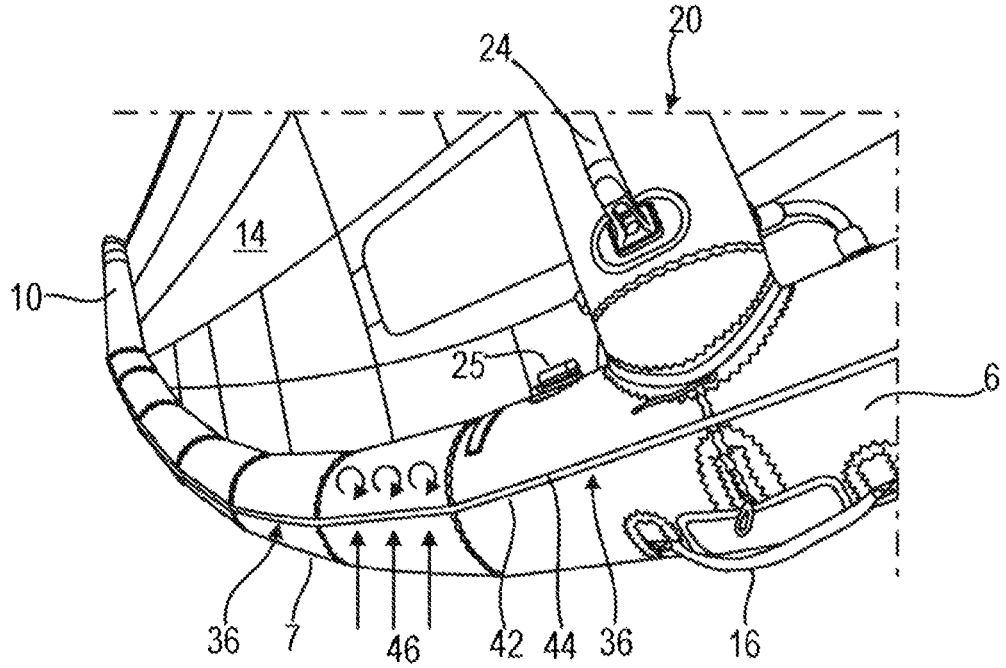
FIG. 3 shows a detailed representation of the example wing rig according to FIG. 2.

FIG. 3 shows an enlarged view of the wing rig 1, in which it can be clearly seen that the spoiler profile 36 extends only as far as tip 8 (or 10). FIG. 3 again schematically shows the inflow 46 with the stall caused by the spoiler profile 36. In this illustration, the widened base 42 and the tapered stalling edge 44 can also be seen.

Figure 4:
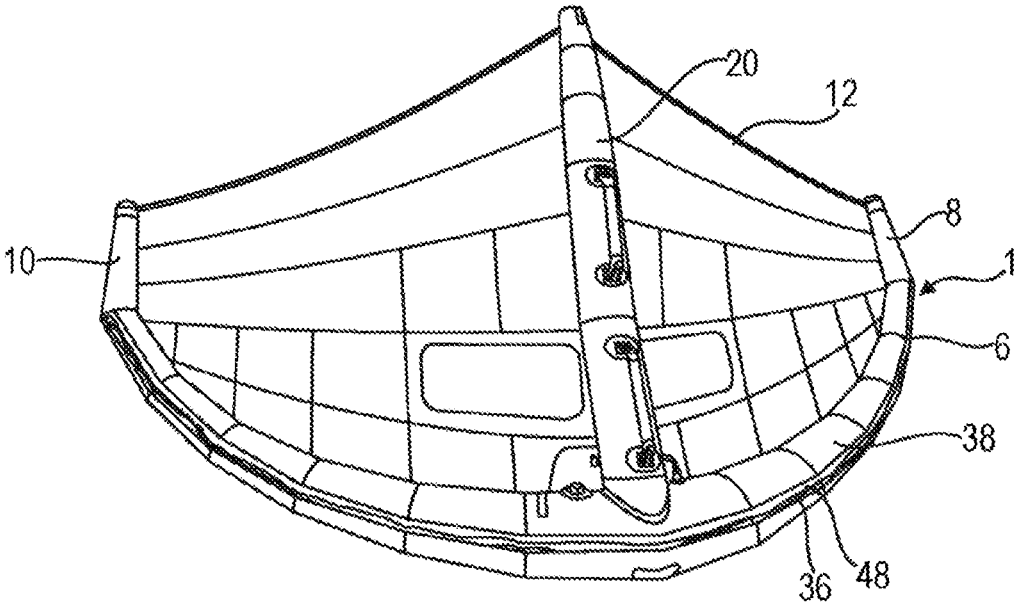
FIG. 4 shows a second example of a wing rig with a spoiler profile overstretched by a cover.

FIG. 4 shows an example of a wing rig 1 which in principle has the same structure as the wing rig 1 shown in FIGS. 2 and 3. The essential difference between the two variants is that in the example according to FIG. 4, the spoiler profile 36, which protrudes approximately towards the observer and causes, among other things, a stall, is covered by a cover 48. This can be designed, for example, in the form of a tape which fixes the spoiler profile 36 in position on the outer skin 38 of the front tube 6 and covers the latter. Also in this example, the spoiler profile 36 extends into the region of the two tips 8, 10. Such a variant is particularly well suited for retrofitting conventional wing rigs 1, for which, for example, the spoiler profile 36 can be integrated into the cover 48, so that the spoiler profile 36 according to the disclosure can be attached in the manner of an adhesive tape. Of course, sewing or other fixing can also be carried out additionally or alternatively.

Figure 5:
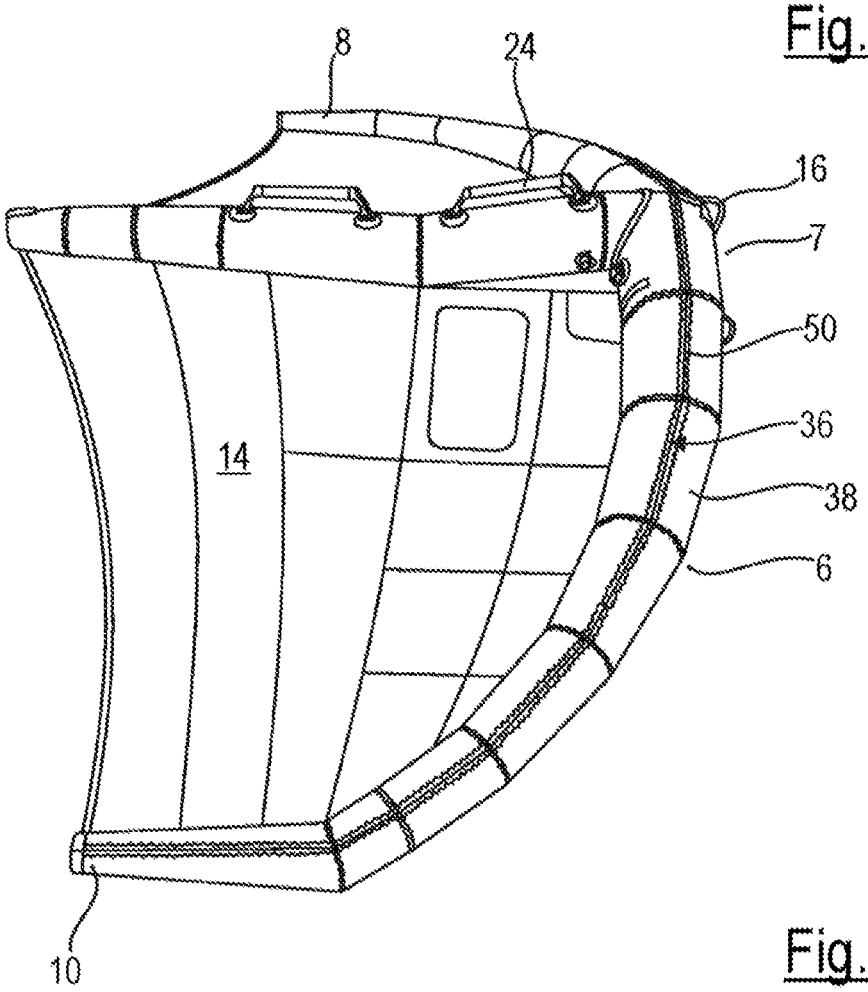
FIG. 5 shows an example in which the spoiler profile is formed by a seam construction.
Figure 6:
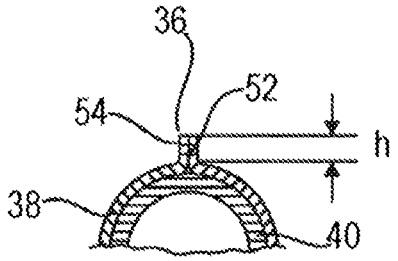
FIG. 6 shows a detailed illustration of an example spoiler profile with radially adjusted seam construction.

FIG. 5 shows an example in which the spoiler profile 36 is integrated, so to speak, into the outer skin 38 of the front tube 6. In this example, a seam 50 of the outer skin 38 is formed in the area of the front tube 6 where the stall (or other flow change) is to occur. As explained, this region is formed on the underside of the leading edge 7 facing the viewer in FIG. 5, at a distance from the canopy 14. As explained above, this seam 50 is located in the approximately tangentially impinged area of the leading edge 7. The seam 50 can be formed by material doubling or adjustment as shown in FIG. 6, and the corresponding design of the seam geometry can be such that a spoiler profile 36 is formed projecting away from the outer skin 38, approximately in the radial direction, which generates the stall. Accordingly, the seam 50 is selected to produce a deliberate stall or other flow reversal.

In the example shown in FIG. 6, sewn-together longitudinal edge regions 52, 54 of the outer skin 38 are set outwards in an approximately radial direction, so that the spoiler profile 36 is formed by the radially projecting, set-on longitudinal edge regions 52, 54. These may still be covered with a cover to prevent damage.

The outer skin 38 may be made of a textile material, such as Dacron® or a laminate or foil construction, such as Aluula®. In the case of a laminate/foil structure, it is preferred that the height h of the spoiler profile 36 be slightly greater than that of textile materials.

As explained above, typically the front tube 6 and/or canopy 14 is formed from multiple panels/segments that are also sewn together. In the region of this segment transition, the spoiler profile 36 may then have a greater height than in the adjacent regions. These protrusions formed due to the segment transitions are, for example, in the range between 0.5 mm and 1 mm or more (depending on the material thickness). For example, if a spoiler profile height of about 5 mm were selected for a textile material, the height in the segment transition area would then be 5.5 mm or more. In the case of a foil material or in the case of laminate, the spoiler profile 36 is preferably designed with a somewhat greater height, this then being approximately in the range of 7.0 mm, so that there is correspondingly a profile height of 7.5 mm or more in the region of the segment transition. In the case of front tubes made of a hybrid material, the front tube 6 consisting, for example, of a laminate/foil material reinforced in the seaming area by textile strips (for example Dacron®), the seam height, and thus, the height h of the spoiler profile 36 corresponds at least to the height of the base material in the seaming area.

As explained above, the spoiler profile 36 is optimally arranged in the lower region, preferably in the approximately tangentially impinged region of the front tube 6, so that the stall occurs in the predetermined manner.

A seam course in the lower area of the front tube 6 with a profiling creating a spoiler profile 36 is also without precedent in the prior art. In the example shown, this seam 50 also extends into the tips 8 (10). In all other respects, the example according to FIG. 5 corresponds to the examples described above, so that further explanations are unnecessary.

In the above-described examples, the center strut 20 is designed to be inflatable. Of course, an example with a rigid boom or a hybrid form with center strut 20 and boom can also be used.

In the above-described examples, a trapeze rope or handle can be attached to the two handles 24, so that the wing rig 1 can then also be guided/held via a trapeze harness or with one hand.

Disclosed is a hand-held wing rig 1 having a spoiler profile 36 formed approximately in the lower, tangentially impinging region of the leading edge 7.

Figure 7:
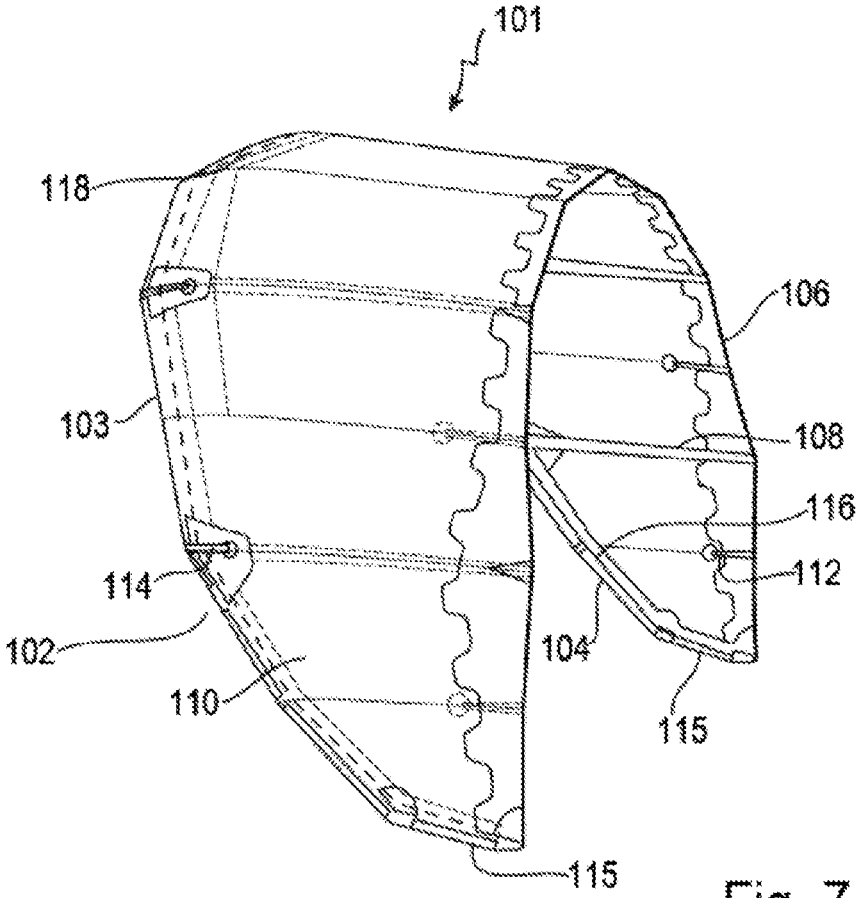
FIG. 7 shows the principle of a kite.

FIG. 7 illustrates the basic structure of a tube kite, hereinafter referred to as a kite 101. Such a kite 101 has a support structure 102 with a front tube 104, which forms a leading edge 103. Attached to this front tube 104 in the illustrated example (Rebel®) are a plurality of struts 108 extending toward a trailing edge 106. This support structure 102 with the front tube 104 and five struts 108 spans a canopy 110 forming the actual kite surface. In the illustrated example, a plurality of sail batten-shaped stiffening elements 112 are provided in the area of the trailing edge 106. To stabilize the profile, profile stabilizing elements 114 may also be provided in the area of the front tube 104 to profile the leading-edge area. Such stabilizing elements are disclosed, for example, in DE 20 2005 018 317 U1 of the applicant.

The kite 101 is connected to the surfer by two front lines, not shown, and two control lines tied to tips 115 of the kite 101, and by a bar, not shown.

According to the disclosure, a spoiler profile 116—also called a bead or "boundary layer trip strip" (BLTS)—is formed in the kite 101 in a region of the front tube 104 which is flowed against approximately tangentially. It is particularly preferred if this spoiler profile 116 is formed in the lower region of the front tube 104 facing the bar. In principle, such a spoiler profile 116 can also be additionally or alternatively designed on the canopy side.

Figure 8:
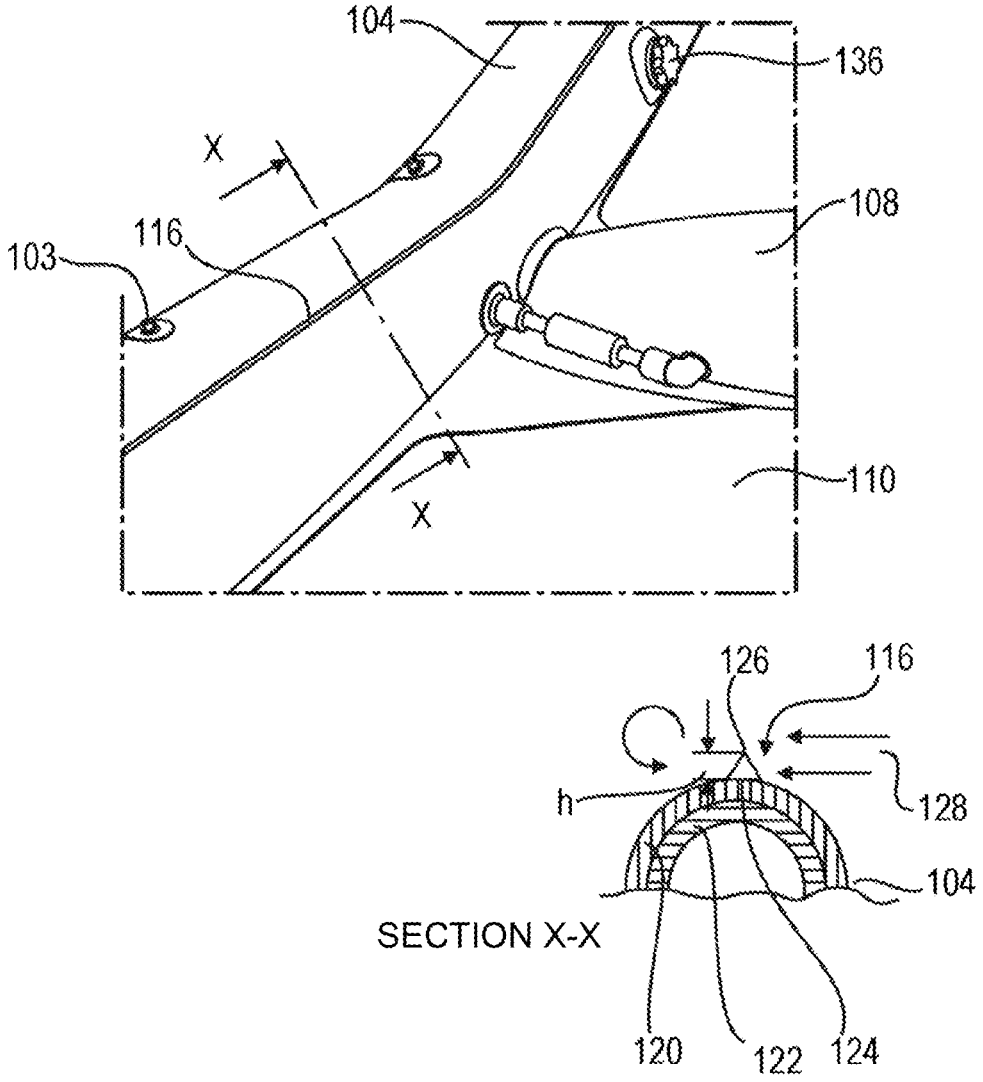
FIG. 8 a partial bottom view of an example kite according to the disclosure.

FIG. 8 shows a bottom view of the kite 101, in which a center strut 108 is seen tethered to the front tube 104 in the region of an apex 118 of the front tube 104. The front tube 104 and the struts 108 are inflated via a one-pump system 136, which is also used to inflate the front tube 104.

According to the partial bottom view in FIG. 8, in the example shown, the spoiler profile 116 is formed as a plastic profile which is connected in a suitable manner to the front tube 104, in particular to the outer skin 120 of the front tube 104. This connection can be made, for example, by gluing, sewing or by suitable design of the front tube 104. The spoiler profile 116 may be continuous or formed from spoiler profile sections spaced apart from one another.

In principle, the spoiler profile 116 can also be designed with different heights to optimize the stall.

In the illustrated example, this spoiler profile 116 extends from an apex 118 (arc) to the tips 115, as described above.

Section X-X of FIG. 8 schematically shows the cross-section of the spoiler profile 116. The outer skin 120 of the front tube 104 can be seen, which preferably surrounds a bladder 122 in a generally known manner. If the outer skin 120 is gas-tight, the bladder 122 may be skipped. The cross-sectional profile of the front tube 104 is approximately circular or oval in shape. In the area away from the canopy 110, the spoiler profile 116 is attached. In the example shown, this is formed as a plastic profile body with a comparatively wide base 124 along which the spoiler profile 116 is connected to the outer skin 120. As explained, this connection can be made by gluing, sewing or the like.

The spoiler profile 116 tapers from the base 124 to a stalling edge 126, which in the example shown is relatively sharp-edged, so that when the kite 101 is in use, the incident flow marked with the reference sign 128, which is approximately tangential to this region of the leading edge 103, breaks off and/or changes from a largely laminar flow to a turbulent region and/or the flow separates downstream of the spoiler profile 116. Surprisingly, it was shown that this flow change in the area of the underside of the leading edge 103/front tube 104 significantly improves the aerodynamics of the kite 101 compared to conventional solutions, so that, on the one hand, higher driving speeds can be achieved and, on the other hand, the "flight stability" is significantly improved.

In the example shown, the height h of the spoiler profile 116 is preferably higher than 3 mm for an outer skin 120 made of Dacron®. In principle, other dimensions can also be used. In the illustrated example, the stalling edge 126 is designed with a relatively sharp edge. In principle, this can also be somewhat rounded. The profile of the spoiler profile 116 is also by no means limited to the shape shown, but the profiling can also be carried out in other ways to achieve the desired effect (for example, stall, separation or reversal laminar/turbulent flow).

Figure 9:
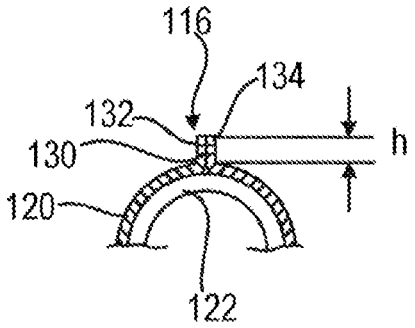
FIG. 9 shows a detailed view of an example spoiler profile with radially adjusted seam construction.

FIG. 9 shows an example in which the spoiler profile 116 is integrated, so to speak, into the outer skin 120 of the front tube 104. In this exemplary example, a seam 130 of the outer skin 120 is formed in the area of the front tube 104 where the stall (or other flow change) is to occur. As explained, this region is formed on the underside of the leading edge 103 facing the viewer in FIG. 8, at a distance from the canopy 110. As described, this seam 130 is located in the approximately tangentially impinged area of the leading edge 103. The seam 130 can be designed by material doubling or adjustment and corresponding design of the seam geometry in such a way that a spoiler profile 116 is formed projecting away from the outer skin 120, approximately in the radial direction, which generates the stall. Accordingly, the seam 130 is selected to create a deliberate stall or other flow reversal.

In the exemplary example shown in FIG. 9, sewn-together longitudinal edge regions 132, 134 of the outer skin 120 are set outwards in an approximately radial direction, so that the spoiler profile 116 is formed by the radially projecting, set-on longitudinal edge regions 132, 134. These may still be covered with a cover to prevent damage.

The outer skin 120 may be made of a textile material, such as Dacron® or a laminate or film construction, such as Aluula®. In the case of a laminate/foil construction, it is preferred if the height h of the spoiler profile 116 is slightly greater than that of textile materials. In particular, when using a laminate/foil structure (for example Aluula®), a bladder 122 can be omitted.

As explained above, typically the front tube 104 and/or canopy 110 is formed from multiple panels/segments that are also sewn together. In the region of this segment transition, the spoiler profile 116 may then have a greater height than in the adjacent regions. These protrusions formed due to the segment transitions are, for example, in the range between 0.5 mm and 1 mm or more (depending on the material thickness). For example, if a spoiler profile height of about 3 mm were selected for a textile material, the height in the segment transition area could then be 3.5 mm or more. In the case of a foil material or in the case of laminate, the spoiler profile 116 is preferably designed with a somewhat greater height, this then being approximately in the range of 5.0 mm, so that there is correspondingly a profile height of 5.5 mm or more in the region of the segment transition. In the case of front tubes made of a hybrid material, the front tube 104 consisting, for example, of a laminate/foil material reinforced in the seaming area by textile strips (for example Dacron®), the seam height, and thus, the height h of the spoiler profile 116 corresponds at least to the height of the base material in the seaming area.

As explained above, the spoiler profile 116 is optimally arranged in the lower region, preferably in the approximately tangentially impinged region of the front tube 104, so that the stall occurs in the predetermined manner.

A seam course in the lower region of the front tube 104 with a spoiler profile 116 creating profile is without precedent in the prior art. In the illustrated example, this seam 130 also extends into the tips 115. In principle, the spoiler profile 116 can also end in front of the tips 115.

Disclosed is a kite 101 having a spoiler profile 116 formed approximately in the lower, tangentially impinged region of the leading edge 103.

LIST OF REFERENCE SYMBOLS

1 wing rig
2 foilboard
4 surfer
6 front tube
7 leading edge
8 tip
10 tip
12 trailing edge
14 canopy
16 handle
18 safety leash
20 center strut
22 apex
24 handle
25 one-pump system
26 adapter
34 front tube section
36 spoiler profile
38 outer skin
40 bladder
42 base
44 stalling edge
46 inflow
48 cover
50 seam
52 longitudinal edge area
54 longitudinal edge area
101 tubekite
102 support structure
103 leading edge
104 front tube
106 trailing edge
108 strut
110 canopy
112 stiffening element
114 profile stabilizer element
115 tip
116 spoiler profile
118 apex/Arc
120 outer skin
122 bladder
124 base
126 stalling edge
128 inflow
130 seam
132 longitudinal edge area
134 longitudinal edge area
136 one-pump system

What is claimed is:

1. A hand-held wing rig comprising:

an inflatable front tube forming a leading edge; and a rigid or inflatable center strut on which a handle can be arranged; wherein:

the inflatable front tube together with the rigid or inflatable center strut span a canopy; and a radially projecting spoiler profile is formed on the leading edge of the front tube;

wherein:

either the spoiler profile is formed as an attached profile body; and/or the spoiler profile is covered by a cover; and/or the spoiler profile has a widened base provided with an adhesive layer; and/or a plurality of spoiler profile sections are arranged spaced apart from each other; and/or a plurality of spoiler profile sections are designed with different heights.

2. The hand-held wing rig according to claim 1, wherein the spoiler profile is formed on an underside of the leading edge facing a user, and in use is flowed against approximately tangentially, and/or the spoiler profile follows a contour of the leading edge in its longitudinal direction at least section-wise.

3. The hand-held wing rig according to claim 1, wherein the spoiler profile has a height of more than 5 mm.

4. The hand-held wing rig according to claim 3, wherein an outer skin of the front tube is made of a textile material or a laminate/foil material or a hybrid material, wherein the height of the spoiler profile is lower when using a textile material than when using a laminate/foil material, wherein the height is ≥5 mm, when a textile material is used and is ≥7 mm when a laminate/foil material is used and, in a case of a hybrid material, corresponds at least to the height assigned to a base material in a seaming area, the base material being a textile, laminate, and/or foil.

5. The hand-held wing rig according to claim 1, wherein the spoiler profile is formed as a seam.

6. The hand-held wing rig according to claim 1, wherein the spoiler profile extends substantially between tips of the wing rig.

7. The hand-held wing rig according to claim 1, wherein the spoiler profile is adapted to generate a laminar or turbulent stall or a flow reversal at the wing rig's underside, and/or wherein the spoiler profile forms a stalling edge.

8. A kite comprising an inflatable front tube forming a leading edge and at least one strut, wherein:

the inflatable front tube and the at least one strut together span a canopy, and a radially projecting spoiler profile is formed on the leading edge of the front tube, and further wherein:

either the spoiler profile is formed as an attached profile body; and/or the spoiler profile is covered by a cover; and/or the spoiler profile has a widened base provided with an adhesive layer; and/or a plurality of spoiler profile sections are arranged spaced apart from each other; and/or a plurality of spoiler profile sections are designed with different heights.

9. The kite according to claim 8, wherein the spoiler profile is formed on an underside of the leading edge facing a user, and in use is flowed against approximately tangentially, and/or the spoiler profile follows a contour of the leading edge in a longitudinal direction thereof at least section-wise.

10. The kite according to claim 8, wherein the spoiler profile has a height greater than 3 mm.

11. The kite according to claim 10, wherein an outer skin of the front tube is made of a textile material or a laminate/foil material, wherein the height of the spoiler profile is less in a case of a textile material than in a case of a laminate/foil material, wherein the height is ≥3 mm when using a textile material and is ≥5 mm when using a laminate/foil material and, in the case of a hybrid material, corresponds at least to the height assigned to a base material in a seaming area, the base material being a textile, laminate, and/or foil.

12. The kite according to claim 8, wherein the spoiler profile is formed as a seam.

13. The kite according to claim 8, wherein the spoiler profile extends substantially between tips of the kite.

14. The kite according to claim 8, wherein the spoiler profile is adapted to create a laminar or turbulent stall or a flow reversal at an underside of the kite, and/or wherein the spoiler profile forms a stalling edge.

15. The hand-held wing rig according to claim 3, wherein the height of the spoiler profile is ≥6 mm when a textile material is used, and ≥8 mm when a laminate/foil material is used.

16. The kite according to claim 11, wherein the height of the spoiler profile is ≥5 mm when using a textile material and ≥7 mm when using a laminate/foil material.

* * * * *